US006054237A

United States Patent [19]

Ishida et al.

[11] Patent Number: 6,054,237

[45] Date of Patent: Apr. 25, 2000

[54] ELECTROPHOTOGRAPHIC PHOTORECEPTOR, PROCESS FOR PRODUCING THE SAME, AND IMAGE FORMING APPARATUS USING SAME

[75] Inventors: Kazuya Ishida, Kashiba; Kiyofumi Morimoto, Yamatokoriyama; Satoshi Katayama, Nabari; Takahiro Teramoto, Tenri; Akihiko Kawahara; Kazushige Morita, both of Nara, all of Japan

[73] Assignee: Sharp Kabushiki Kaisha, Japan

[21] Appl. No.: 09/210,785

[22] Filed: Dec. 15, 1998

[30] Foreign Application Priority Data

Dec. 26, 1997 [JP] Japan ..... 9-360656

[51] Int. Cl.[7] ..... G03G 5/06

[52] U.S. Cl. ..... 430/59.4; 430/78

[58] Field of Search ..... 430/58.85, 73, 430/76, 78, 83, 59.4

[56] References Cited

U.S. PATENT DOCUMENTS

| | | | |
|---|---|---|---|
| 5,087,540 | 2/1992 | Murakami et al. | 430/58 |
| 5,312,705 | 5/1994 | Tsuchiya et al. | 430/58 |
| 5,804,344 | 9/1998 | Mitsumori | 430/73 |

FOREIGN PATENT DOCUMENTS

| | | |
|---|---|---|
| 0 408 380 A1 | 1/1991 | European Pat. Off. . |
| 0 469 823 A1 | 2/1992 | European Pat. Off. . |
| 58-182639 | 10/1983 | Japan . |
| 60-19153 | 1/1985 | Japan . |
| 63-267949 | 11/1988 | Japan . |
| 1-307759 | 12/1989 | Japan . |

OTHER PUBLICATIONS

Patent Abstracts of Japan, vol. 95, No. 2, Mar. 31, 1995 & JP 06 308754 A (TOXO INK), Nov. 4, 1994.

Patent Abstracts of Japan, vol. 95, No. 2, Mar. 1995 & JP 06 308755 A (TOYO INK), Nov. 4, 1994.

*Primary Examiner*—John Goodrow

*Attorney, Agent, or Firm*—Nixon & Vanderhye

[57] ABSTRACT

An object of the invention is to provide a highly characteristic image using an electrophotographic photoreceptor of which a charge-generating layer can be produced with a better coating property and which is highly sensitive and electrostatically highly stable in repeated use. The charge-generating layer of a function-separated type photoreceptor contains a n-type non-metallic phthalocyanine and a copolymer of vinyl chloride-vinyl acetate type. Particularly, the ratio of the τ-type non-metallic phthalocyanine to the copolymer of vinyl chloride-vinyl acetate type is fixed at 1/3–3/1 by weight. The thickness of the charge-generating layer is fixed at 0.1–0.6 μm. As the copolymer of vinyl chloride-vinyl acetate type, copolymers of vinyl chloride-vinyl acetate, vinyl chloride-vinyl acetate-maleic acid, or vinyl chloride-vinyl acetate-vinyl alcohol are selected. Particularly, it is favorable to select those containing at least 10% by weight of the vinyl alcohol component. The charge-generating layer is formed with a liquid coating material using a ketone solvent as dispersant. The aforementioned photoreceptor is applied to an image-forming apparatus using an inversion development process.

12 Claims, No Drawings

ELECTROPHOTOGRAPHIC PHOTORECEPTOR, PROCESS FOR PRODUCING THE SAME, AND IMAGE FORMING APPARATUS USING SAME

BACKGROUND OF THE INVENTION

1. Field of the Invention

The present invention relates to an electrophotographic photoreceptor which has high sensitivity in a wide range of the visible ray region to the near infrared region, a process for producing the same, and an image-forming apparatus using the same.

2. Description of the Related Art

The inorganic photoconductive materials which have long been known as materials for the photoreceptive layers in photoreceptors, e.g. selenium, cadmium sulfide and zinc oxide, have some advantages. For example, they can be charged at a proper electric potential in a dark place, the electrical charge on them is hardly dissipated in a dark place, and irradiation of light makes the electrical charge on them rapidly dissipate. On the other hand, the following disadvantages are recognized. For example, in the photoreceptor produced with a selenium material, the condition of production is strict, the production cost is high, and careful handling is required since it is vulnerable to heat or mechanical shock. In the photoreceptor produced with a material of cadmium sulfide or zinc oxide type, no stable sensitivity is attained in an environment of high humidity and no long-range stability characteristic is attained since the pigment added as sensitizer yields charge deterioration by corona charge or photo-fading by exposure. On the other hand, organic photoconductive materials proposed as photoreceptive materials such as polyvinyl carbazole are more advantageous than the inor nic ones in film-forming or lightweight properties.

In making the photoreceptor of organic photoconductive material fit for practical use, a photoreceptor of function-separated type which has been proposed in order to secure high sensitivity, high durability and high stability against an environmental change includes a laminate type and a dispersion type, in which the photoconductive function is separated into a charge-generating function and a charge-transporting function. In such a function-separated photoreceptor, a wide variety of materials for the charge-generating function and the charge-transporting function can be employed, and accordingly, it is possible to select the optimal material to provide a highly efficient photoreceptor in the electrophotographic characteristics such as electrically charged property, sensitivity, residual electric potential, characteristics in repeated use, and copying durability. Moreover, it is possible to provide a photoreceptor in very high productivity at low cost because it can be produced by means of a conventional coating operation. Furthermore, the range of the photoreceptive wavelength can be optionally selected by using the material for charge-generating function.

Particularly, phthalocyanines which are highly sensitive up to the range of relatively long wavelength have been used as charge-generating materials and recently they have been employed effectively in a kind of high-speed printer, i.e. laser printer of electrophotographic system using a laser source. Examples of the phthalocyanine photoreceptors have been disclosed in Japanese Unexamined Patent Publications JP-A 58-182639(1983), JP-A60-19153 (1985) and JP-A63-267949 (1988). In JP-A 58-182639, τ-type and η-type non-metallic phthalocyanines are used, and in JP-A 60-19153, modified τ-type and modified η-type non-metallic phthalocyanines are used, respectively. On the other hand, in JP-A 63-267949, a mixture of τ-type, modified τ-type, η-type or modified η-type phthalocyanines with a butyral resin is used. In the photoreceptors prepared with these materials, however, the electrostatic characteristics such as sensitivity and electrostatic stability in repeated use are not sufficient for practical use.

Moreover, in JP-A 1-307759, an electrophotographic photoreceptor having a charge-generating layer in which a vinyl chloride type copolymer resin is used as a binder is disclosed. In such a photoreceptor, however, an electrostatic characteristic sufficient for practical use is not attained.

SUMMARY OF THE INVENTION

An object of the invention is to provide an electrophotographic photoreceptor which has a good dispersible charge-generating layer and is excellent in electrostatic characteristics, particularly, sensitivity and electrostatic stability in repeated use. Another object of the invention is to provide a process for producing an electrophotographic photoreceptor with which a charge-generating layer can be formed with a good applicability. A further object of the invention is to provide an image-forming apparatus using an electrophotographic photoreceptor by which an image excellent in image characteristics can be formed.

The invention relates to an electrophotographic photoreceptor comprising a conductive support, a charge-generating layer and a charge-transporting layer, the charge-generating and charge transporting layers being provided on the conductive support, wherein the charge-generating layer comprises a τ-type non-metallic phthalocyanine and a vinyl chloride-vinyl acetate type copolymer.

According to the invention, in the function-separated photoreceptor, an electrophotographic photoreceptor which is excellent in electrostatic characteristics, particularly, sensitivity and electrostatic stability in repeated use can be provided by making the τ-type non-metallic phthalocyanine and the copolymer of vinyl chloride-vinyl acetate type contained in the charge-generating layer.

Moreover, the invention is characterized in that a ratio of the τ-type non-metallic phthalocyanine to the copolymer of vinyl chloride-vinyl acetate type is in a range of 1/3–3/1 by weight (τ-type non-metallic phthalocyanine/copolymer of vinyl chloride-vinyl acetate type).

According to the invention, the sensitivity and the electrostatic stability in repeated use are further improved by fixing the ratio of the τ-type non-metallic phthalocyanine to the copolymer of vinyl chloride-vinyl acetate type in a range of 1/3–3/1 by weight.

Moreover, the invention is characterized in that a thickness of the charge-generating layer is fixed in a range of 0.1 μm–0.6 μm.

According to the invention, excellent sensitivity and electrostatic stability in repeated use can be obtained by fixing the thickness of the charge-generating layer in a range of 0. μm–0.6 μm.

Moreover, the invention is characterized in that a vinyl chloride-vinyl acetate copolymer is selected as the copolymer of vinyl chloride-vinyl acetate type.

According to the invention, excellent sensitivity and electrostatic stability in repeated use can be obtained by selecting the vinyl chloride-vinyl acetate copolymer as the copolymer of vinyl chloride-vinyl acetate type.

Moreover, the invention is characterized in that a vinyl chloride-vinyl acetate-maleic acid copolymer is selected as the copolymer of vinyl chloride-vinyl acetate type.

According to the invention, excellent sensitivity and electrostatic stability in repeated use can be obtained by selecting the vinyl chloride-vinyl acetate-maleic acid copolymer as the copolymer of vinyl chloride-vinyl acetate type.

Moreover, the invention is characterized in that a vinyl chloride-vinyl acetate-vinyl alcohol copolymer is selected as the copolymer of vinyl chloride-vinyl acetate type.

According to the invention, excellent sensitivity and electrostatic stability in repeated use can be obtained by selecting the vinyl chloride-vinyl acetate-vinyl alcohol copolymer as the copolymer of vinyl chloride-vinyl acetate type.

Moreover, the invention is characterized in that a content of the vinyl alcohol component is at least 10% by weight calculated as a monomer in the vinyl chloride-vinyl acetate-vinyl alcohol copolymer.

According to the invention, excellent sensitivity and electrostatic stability in repeated use can be obtained by using the vinyl chloride-vinyl acetate-vinyl alcohol copolymer containing at least 10% by weight (calculated as a monomer) of the vinyl alcohol component.

The invention also provides a process for producing an electrophotographic photoreceptor comprising a conductive support, and charge-generating and charge-transporting layers provided on the conductive support, the process comprising the step of applying a liquid coating material for forming the charge-generating layer to the conductive support to form the charge-generating layer, wherein the liquid coating material for forming the charge-generating layer is prepared by dispersing aτ-type non-metallic phthalocyanine in a ketone type solvent.

According to the invention, in producing the function-separated photoreceptor, particularly, the liquid coating material for forming the charge-generating layer is produced by dispersing the τ-type non-metallic phthalocyanine in the ketone type solvent, and the charge-generating layer is formed by applying the liquid coating material. Since the liquid coating material is highly dispersible, the charge-generating layer can be formed based on the high applicability of this solution. Thus prepared electrophotographic photoreceptor exhibits high sensitivity and electrostatic stability in repeated use as mentioned above.

Moreover, the invention is characterized in that the liquid coating material for forming the charge-generating layer contains a copolymer of vinyl chloride-vinyl acetate type as a binder resin.

According to the invention, the liquid coating material for forming the charge-generating layer comprises a copolymer of vinyl chloride-vinyl acetate type as a binder resin. By using the liquid coating material, high applicability can be attained to form the charge-generating layer.

Moreover, the invention is characterized in that the liquid coating material contains a vinyl chloride-vinyl acetate-maleic acid copolymer as the copolymer of vinyl chloride-vinyl acetate type.

According to the invention, the liquid coating material comprises the vinyl chloride-vinyl acetate-maleic acid copolymer as the copolymer of vinyl chloride-vinyl acetate type. By using the liquid coating material, high applicability can be attained to form the charge-generating layer.

Moreover, the invention is characterized in that the liquid coating material contains a vinyl chloride-vinyl acetate-vinyl alcohol copolymer as the above-mentioned copolymer of vinyl chloride-vinyl acetate type.

According to the invention, the liquid coating material comprises the vinyl chloride-vinyl acetate-vinyl alcohol copolymer as the copolymer of vinyl chloride-vinyl acetate type. By using the liquid coating material, high applicability can be attained to form the charge-generating layer.

Moreover, the invention relates to an image-forming apparatus in which an electrophotographic photoreceptor is used to form an image by an inversion development process, wherein the electrophotographic photoreceptor is any one of the preceding electrophotographic photoreceptors.

According to the invention, the electrophotographic photoreceptor can be applied to an image-forming apparatus using an inversion development process to form an image excellent in the image characteristics.

The followings are explanation of the materials constituting the electrophotographic photoreceptor of the invention.

As the charge-generating materials contained in the charge-generating layer, the well-known τ-type non-metallic phthalocyanines can be used. For example, the materials disclosed in JP-A 58-182639, JP-A 60-19153, and JP-A 63-267949 can be used. These non-metallic phthalocyanines may be used in combination of two or more species.

In an X-ray diffraction spectra, the τ-type non-metallic phthalocyanine used exhibits strong peaks at 7.2, 9.2, 16.8, 17.4, 20.4 and 20.9 of the Bragg's angle (2θ0.2°). It is desirable to use, particularly, in the infrared absorption spectra, those having four absorption bands between 700–760 $cm^{-1}$, in which the band at 751±2 $cm^{-1}$ is the most intensive, two bands of approximately the same intensity between 1320–1340 $cm^{-1}$, and a characteristic peak at 3288±3 $cm^{-1}$.

The followings are features of a representative process for producing the τ-type non-metallic phthalocyanines. An α-type non-metallic phthalocyanine is subjected to milling by stirring or mechanical distortion force at a temperature of 50–180° C., preferably, 60–130° C., for a time sufficient for generating the τ-type. Since there are some errors in the X-ray diffraction spectra and infrared absorption spectra due to the lattice defect or process of transformation in the crystals depending on the condition of production, the condition is indicated by the above-mentioned range.

The α-type non-metallic phthalocyanines used as the starting materials for the τ-type non-metallic phthalocyanines can be produced according to the known process described in Moser and Thomas "Phthalocyanine Compounds" or other proper processes. The non-metallic phthalo-cyanines used in production of the α-type non-metallic phthalocyanines can be produced by acid treatment of metallic phthalocyanines, e.g. lithium phthalocyanine, sodium phthalocyanine, calcium phthalocyanine and magnesium phthalo-cyanine, from which the metals can be removed with an acid, e.g. sulfuric acid. Alternatively, they may be synthesized directly from phthalodinitrile, aminoiminoisoindolenine or alkoxyiminoiso-indolenine. The non-metallic phthalocyanines are preferably dissolved in an acid, e.g. sulfuric acid, at 5° C. or lower, or converted into the acid salts, then poured into water, preferably into ice water for reprecipitation, or hydrolyzed to give the α-type non-metallic phthalocyanines.

The α-type non-metallic phthalocyanines are stirred or subjected to milling in a dry state or aqueous paste state. In this operation, the same dispersing medium as those used in dispersion, emulsification or mixing of conventional pigments, for example, glass beads, steel beads or zirconia beads, may be used. The dispersing medium may not necessarily be used. As for the dispersing media, those that are in a liquid state at the temperature during stirring or milling may be used, for example, solvents of alcohol type, e.g. glycerin, ethylene glycol and diethylene glycol, polyethylene glycol type, cellosolve type, e.g. ethylene glycol monomethyl ether and ethylene glycol monobutyl ether, ketone type, and ester type.

The stirring or milling apparatus used in the step of crystal transition of the α-type to the τ-type includes, for example, sand mill, kneader, homomixer, agitator, stirrer, banbury mixer, ball mill, atriter, and paintshaker. The temperature in the step of crystal transition may be fixed in a range of 50–180° C., preferably 60–130° C. Moreover, a crystal nucleus may be used in the same manner as in the conventional crystal transition.

The crystal transformation rate depends on various conditions such as efficiency of stirring or milling, distortion force, raw materials, particle size and temperature. After completion of the crystal transformation step, the milling auxiliary and dispersing medium are removed by a conventional purification method, and the product is dried to give the objective τ-type non-metallic phthalocyanines.

As for the τ-type non-metallic phthalocyanine used, there is a modified τ-type non-metallic phthalocyanine which, in an X-ray diffraction spectra, exhibits strong peaks at 7.5, 9.1, 16.8, 17.3, 20.3, 20.8, 21.4 and 21.7 of the Bragg's angle (2θ0.2°). As for the modified τ-type non-metallic phthalocyanine, it is desirable to use, particularly, in the infrared absorption spectra, those having the four absorption bands between 700–760 $cm^{-1}$, in which the band at 753±2 $cm^{-1}$ is the most intensive, two bands of approximately the same intensity between 1320–1340 $cm^{-1}$, and a characteristic peak at 3297±3 $cm^{-1}$. The modified τ-type non-metallic phthalocyanines maybe produced in the same manner as in production of the τ-type non-metallic phthalocyanines.

As for the binder resins contained in the charge-generating layer, copolymers of vinyl chloride-vinyl acetate type are used. Particularly, those in which the ratio of vinyl chloride to vinyl acetate is in a range of 95/5–50/50 (vinyl chloride/vinyl acetate) are used. In addition to vinyl chloride and vinyl acetate, the third copolymer component may be contained up to 15% by weight of the whole copolymer. The third copolymer component includes vinyl alcohol and maleic acid. The molecular weight of the copolymers of vinyl chloride-vinyl acetate type is preferably in a range of 3,000–80,000.

The copolymers of vinyl chloride-vinyl acetate type include those of vinyl chloride-vinyl acetate, vinyl chloride-vinyl acetate-vinyl alcohol, vinyl chloride-vinyl acetate-maleic acid, vinyl chloride-vinyl acetate-vinyl alcohol-maleic acid, and vinyl chloride-vinyl acetate-acrylic aicd.

In the charge-generating layer, it is assumed that the coexistence of the τ-type non-metallic phthalocyanine and the copolymer of vinyl chloride-vinyl acetate type improves the efficiency of carrier generation or of charge injection to improve greatly an electrostatic character, particularly the sensitivity, and greatly improve the stability of electric potential in repeated use.

Since the liquid coating materials for forming the charge-generating layer which contains the τ-type non-metallic phthalocyanine and the copolymer of vinyl chloride-vinyl acetate type have a very stable dispersibility, a defect of the coating at the application is reduced to prevent an incidence of image defects.

In the charge-generating layer, the compounding ratio (by weight) of the charge-generating material to the binder resin is fixed in a range of 1/10–20/1 (charge-generating material/binder resin). When the ratio is less than 1/10, the sensitivity is so low that it might not be used practically. On the other hand, the ratio over 20/1 is not preferable because an electrically charged property is markedly reduced in repeated use. As shown in Examples mentioned below, the preferred ratio is in a range of 1/3–3/1. The thickness of the charge-generating layer is fixed in a range of 0.05 μm–5 μm. When the layer is thinner than 0.05 μm, the sensitivity becomes poor. The thickness over 5 μm is not preferable because an electrically charged property is markedly reduced in repeated use. As shown in Examples mentioned below, the preferred thickness is in a range of 0.1 μm–0.6 μm.

The materials for the charge-transporting layer include a hole mobile material and an electron mobile material. The hole mobile material is exemplified by poly-N-carbazoles and their derivatives, poly-γ-carbazolylethyl glutamates and their derivatives, pyrene-formaldehyde condensates and their derivatives, polyvinylpyrene, polyvinylphenanthrene, oxazole derivatives, imidazole derivatives, triphenylamine derivatives, enamine derivatives, and compounds represented by the general formulae (1) to (20).

(1)

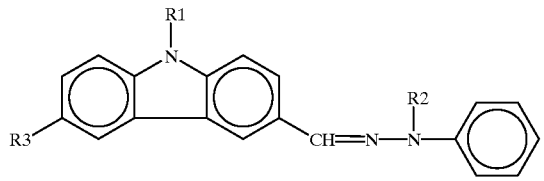

(wherein R1 is methyl, ethyl, 2-hydroxyethyl or 2-chloroethyl; R2 is methyl, ethyl, benzyl or phenyl; R3 is a hydrogen atom, chlorine atom, bromine atom, alkyl of 1–4 carbon atoms, alkoxy of 1–4 carbon atoms, dialkylamino or nitro)

(2)

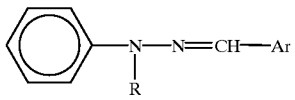

(wherein Ar is naphthalene ring, anthracene ring, styryl ring or their substituted one, or pyridine ring, furan ring, or thiophene ring; R is alkyl or benzyl)

(3)

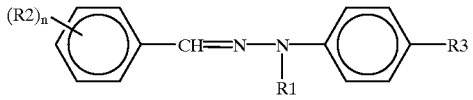

(wherein R1 is alkyl, benzyl, phenyl or naphthyl; R2 is a hydrogen atom, alkyl of 1–3 carbon atoms, alkoxy of 1–3 carbon atoms, dialkylamino, diaralkylamino, or diarylamino; n is an integer of 1–4; when n is 2 or more, R2 may be the same or different each other; R3 is a hydrogen atom or methoxy)

(4)

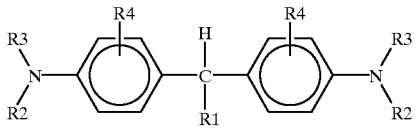

(wherein R1 is alkyl of 1–11 carbon atoms, substituted or unsubstituted phenyl, or heterocyclic group; R2 and R3 are the same or different each representing a hydrogen atom, alkyl of 1–4 carbon atoms, hydroxyalkyl, chloroalkyl, or substituted or unsubstituted aralkyl; alternatively, R2 and R3 may be taken each other to form a nitrogen-containing heterocyclic group; R4 is the same or different each representing a hydrogen atom, alkyl of 1–4 carbon atoms, alkoxy or halogen atom)

(5)

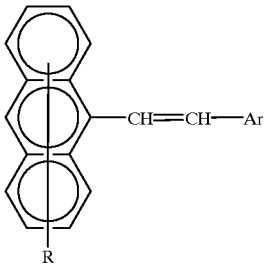

(wherein R is a hydrogen atom or halogen atom; Ar is substituted or unsubstituted phenyl, naphthyl, anthryl, or carbazolyl)

(6)

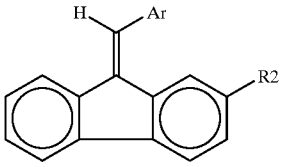

(wherein R1 is a hydrogen atom, halogen atom, cyano, alkoxy of 1–4 carbon atoms, or alkyl of 1–4 carbon atoms; Ar represents a partial formula:

(7)

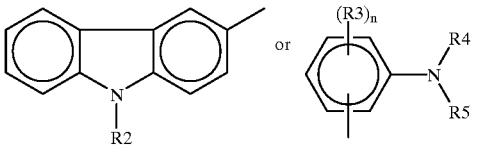

wherein R2 is alkyl of 1–4 carbon atoms; R3 is a hydrogen atom, halogen atom, alkyl of 1–4 carbon atoms, alkoxy of 1–4 carbon atoms, or dialkylamino; n is 1 or 2, and when n is 2, R3 may be the same or different; R4 and R5 each is a hydrogen atom, substituted or unsubstituted alkyl of 1–4 carbon atoms, or substituted or unsubstituted benzyl)

(8)

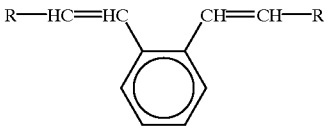

(wherein R is carbazolyl, pyridyl, thienyl, indolyl, furyl, or substituted or unsubstituted phenyl, styryl, naphthyl or anthryl, in which the substituent may be a group selected from the group consisting of dialkylamino, alkyl, alkoxy, carboxy or its ester, halogen atom, cyano, ar-alkylamino, N-alkyl-N-aralkylamino, amino, nitro and acetylamino)

(9)

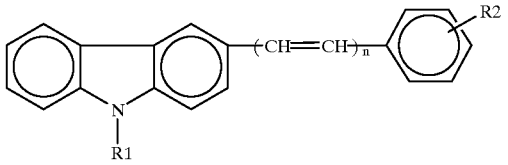

(wherein R1 is lower alkyl, substituted or unsubstituted phenyl, or benzyl; R2 is a hydrogen atom, lower alkyl, lower alkoxy, halogen atom, nitro, amino, or lower alkyl- or benzyl-substituted amino; n is an integer of 1 or 2)

(10)

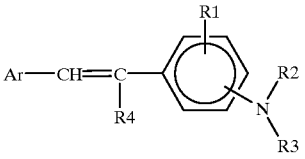

(wherein R1 is a hydrogen atom, alkyl, alkoxy, or halogen atom; R2 and R3 each is alkyl, substituted or unsubstituted aralkyl, or substituted or unsubstituted aryl; R4 is a hydrogen atom, lower alkyl, or substituted or unsubstituted phenyl; Ar is a substituted or unsubstituted phenyl or napththyl)

(11)

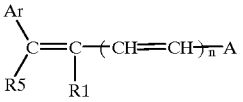

(wherein n is an integer of 0 or 1; R1 is a hydrogen atom, alkyl, or substituted or unsubstituted phenyl; Ar is a substituted or unsubstituted aryl; R5 is alkyl including substituted alkyl, or substituted or unsubstituted aryl; A is a group of formula:

(12)

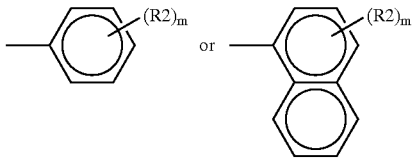

9-anthryl, or substituted or unsubstituted carbazolyl (where R2 is a hydrogen atom, alkyl, alkoxy, halogen atom, or —N(R3,R4)(wherein R3 and R4 each is alkyl, substituted or unsubstituted aralkyl, or substituted or unsubstituted aryl; R3 and R4 may be the same or different; R4 may form a ring)); m is an integer of 0, 1, 2 or 3, and when m is 2 or more, R2 may be the same or different; when n is 0, A and R1 may be combined to form a ring)

(13)

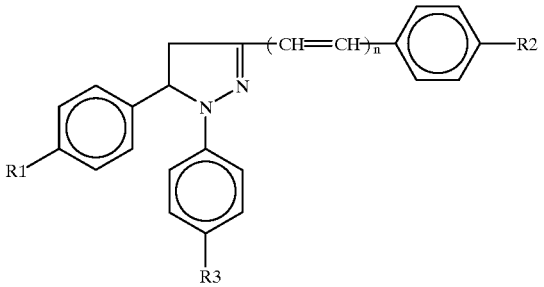

(wherein R1, R2 and R3 each are a hydrogen atom, lower alkyl, lower alkoxy, dialkylamino, or halogen atom; n is 0 or 1)

(14)

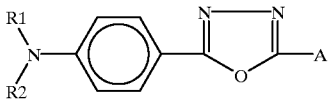

(wherein R1 and R2 each are an alkyl including a substituted alkyl, or substituted or unsubstituted aryl; A is a substituted amino, substituted or unsubstituted aryl, or allyl)

(15)

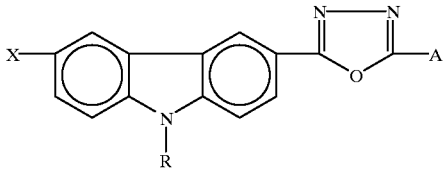

(wherein X is a hydrogen atom, lower alkyl, or halogen atom; R is alkyl including a substituted alkyl, or substituted or unsub-stituted aryl; A is a substituted amino or substituted or unsubstituted aryl)

(16)

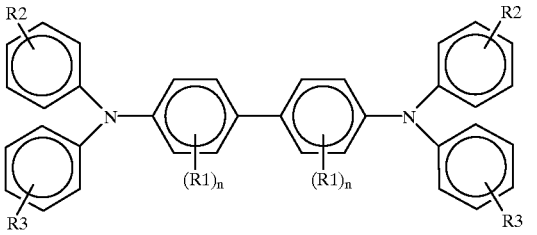

(wherein R1 is a lower alkyl, lower alkoxy, or halogen atom; n is an integer of 0–4; R2 and R3 are the same or different each representing a hydrogen atom, lower alkyl, lower alkoxy, or halogen atom)

(17)

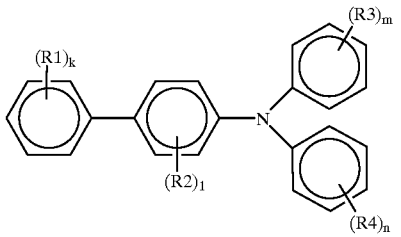

(wherein R2, R3 and R4 each are a hydrogen atom, amino, alkoxy, thioalkoxy, aryloxy, methylene-dioxy, substituted or unsubstituted alkyl, halogen atom, or substituted or unsubstituted aryl; R2 is a hydrogen atom, alkoxy, substituted or unsubstituted alkyl, or halogen atom; provided that such a case that all of R1, R2, R3 and R4 are hydrogen atom is excluded; k, l, m and n are an integer of 1, 2, 3 or 4, and when each is an integer of 2, 3 or 4, the symbol R1, R2, R3 and R4 may be the same or different)

(18)

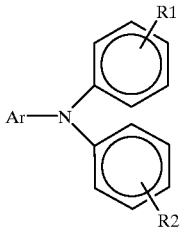

(wherein Ar is a condensed polycyclic hydrocarbon group of 18 or less carbon atoms; R1 and R2 each are a hydrogen atom, halogen atom, substituted or unsubstituted alkyl, alkoxy, or substituted or unsubstituted phenyl, and they may be the same or different)

A—CH═CH—Ar—CH═CH—A (19)

(wherein Ar is a substituted or unsubstituted aromatic hydrocarbon group; A is Ar'—N(R1,R2) (wherein Ar' is a substituted or unsubstituted aromatic hydrocarbon group; R1 and R2 each is a substituted or unsubstituted alkyl, or substituted or unsubstituted aryl))

(20)

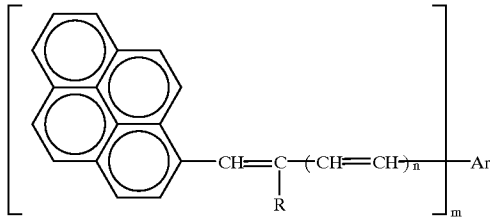

(wherein Ar is an aromatic hydrocarbon group; R is a hydrogen atom, substituted or unsubstituted alkyl, or aryl; n is 0 or 1; m is 1 or 2; when n=0 and m=1, Ar and R may be combined to form a ring) The compounds of the general formula (1) include 9-ethylcarbazole-3-aldehyde-1-methyl-1-phenylhydrazone, 9-ethylcarbazole-3-aldehyde-1-benzyl-1-phenylhydrazone, 9-ethylcarbazole-3-aldehyde-1,1-diphenylhydrazone, and the like. The compounds of the general formula (2) include 4-diethylaminostyrtl-β-aldehyde-1-methyl-1-phenylhydrazone, 4-methoxynaphthalene-1-aldehyde-1-benzyl-1-phenylhydrazone, and the like.

The compounds of the general formula (3) include 4-methoxybenzaldehyde-1-methyl-1-phenylhydrazone, 2,4-dimethoxybenzaldehyde-1-benzyl-1-phenylhydrazone, 4-diethylaminobenz-aldehyde-1,1-diphenylhydrazone, 4-methoxybenzaldehyde-1-benzyl-1-(4-methoxy) phenylhydrazone, 4-diphenylaminobenzaldehyde-1-benzyl-1-phenylhydrazone, 4-dibenzylaminobenzaldehyde-1,1-diphenylhydrazone, and the like.

The compounds of the general formula (4) include 1,1-bis(4-dibenzylaminophenyl)propane, tris(4-diethylaminophenyl)methane, 1,1-bis(4-dibenzylaminophenyl)propane, 2,2-dimethyl-4,4'-bis (diethylamino)-triphenylmethane, and the like. The compounds of the general formula (5) include 9-(4-diethylaminostyryl)anthracene, 9-bromo-10-(4-diethylaminostyryl)anthracene, and the like.

The compounds of the general formula (6) include 9-(4-dimethylaminobenzylidene)fluorene, 3-(9-fluorenylidene)-9-ethylcarbazole, and the like. The compounds of the general formula (8) include 1,2-bis(4-diethylaminostyryl) benzene, 1,2-bis(2,4-dimethoxystyryl)benzene, and the like. The compounds of the general formula (9) include 3-styryl-9-ethylcarbazole, 3-(4-methoxystyryl)-9-ethylcarbazole, and the like.

The compounds of the general formula (10) include 4-diphenylaminostilbene, 4-dibenzyl-aminostilbene, 4-ditolylaminostilbene, 1-(4-diphenylaminostyryl) naphthalene, 1-(4-diethyl-aminostyryl)naphthalene, and the like. The compounds of the general formula (11) include 4'-diphenylamino-α-phenylstilbene, 4'-bis(4-methylphenyl) amino-α-phenylstilbene, and the like.

The compounds of the general formula (13) include 1 -phenyl-3-(4-diethylaminostyryl)-5-(4-diethylaminophenyl) pyrazoline, 1-phenyl-3-(4-dimethylaminostyryl)-5-(4-dimethylamino-phenyl)pyrazoline, and the like. The compounds of the general formula (14) include 2,5-bis(4-diethylaminophenyl)-1,3,4-oxadiazole, 2-N,N-diphenylamino-5-(4-diethylaminophenyl)-1,3,4-oxadiazole, 2-(4-dimethylaminophenyl)-5-(4-di-ethylaminophenyl)-1,3, 4-oxadiazole, and the like.

The compounds of the general formula (15) include 2-N,N'-diphenylamino-5-(N-ethylcarb-azol-3-yl)-1,3,4-oxadiazole, 2-(4-diethyl-aminophenyl)-5-(N-ethylcarbazol-3-yl)-1,3,4-oxadiazole, and the like. The benzidine compounds of the general formula (16) include N,N'-diphenyl-N,N'-bis(3-methylphenyl)-[1,1'-biphenyl]-4,4'-diamine, 3,3'-dimethyl-N,N,N', N'-tetrakis(4-methylphenyl)-[1,1'-biphenyl]-4,4'-diamine, and the like.

The biphenylamine compounds of the general formula (17) include 4'-methoxy-N,N'-diphenyl-[1,1'-biphenyl]-4-amine, 4'-methyl-N,N-bis(4-methylphenyl)-[1,1'-biphenyl]-4-amine, 4'-methoxy-N,N-bis(4-methylphenyl)-[1,1'-biphenyl]-4-amine, and the like. The triarylamine compounds of the general formula (18) include 1-diphenylaminopyrene, 1-di(p-tolylamino)pyrene, and the like.

The di-olefinic aromatic compounds of the general formula (19) include 1,4-bis(4-diphenyl-aminostyryl)benzene, 1,4 -[bis(4-di(p-tolyl)-aminostyryl)]benzene, and the like. The styryl-pyrene compounds of the general formula (20) include 1-(4-diphenylaminostyryl)pyrene, 1-[4-di(p-tolyl) aminostyryl]pyrene, and the like.

On the other hand, the electron mobile material includes, for example, chloranil, bromanil, tetracyanoethylene, tetracyanoquino-dimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-indeno-4H-indeno[1,2-b]thiophen-4-one, 1,3,7-trinitrodibenzothiophene-5,5-dioxide, and 3,5-dimethyl-3', 5'-di-tert-butyl-4,4'-diphenoquinone.

The above-mentioned hole mobile material and charge-transporting material may be used alone or in combination of two or more species.

The binder resin used in the charge-transporting layer includes polycarbonates (bisphenol A type, bisphenol Z type), polyesters, methacrylic resin, acrylic resin, polyethylene, poly(vinyl chloride), poly(vinyl acetate), polystyrene, phenol resins, epoxy resins, polyurethane, poly-(vinylidene chloride), alkyd resin, silicon resin, poly (vinyl carbazole), poly(vinyl butyral), poly-(vinyl formal), polyacrylate, polyacrylamide, polyamide, phenoxy resin, and the like. These binder resins may be used alone or in combination of two or more species.

The solvent used in the charge-transporting layer includes N,N'-dimethylformamide, acetone, methyl ethyl ketone, xylene, chloroform, 1,2-dichloroethane, dichloromethane, monochloro-benzene, tetrahydrofuran, dioxane, methanol, ethanol, isopropanol, ethyl acetate, butyl acetate, and dimethylsulfoxide.

The compounding ratio (by weight) of the charge-transporting material to the binder resin is preferably in a range of 1/2–5/1. The thickness of the charge-transporting layer is preferably in a range of 5 μm–50 μm.

It is appropriate to make a charge-transporting material contained in the charge-generating layer in order to reduce the electric potential and improve the electrically charged property and sensitivity. As for the charge-transporting materials, either of the hole mobile materials or the electron mobile materials may be used. When a hole mobile material has been used in the charge-transporting layer, it is particularly effective to make an electron mobile material contained in the charge-generating layer. On the other hand, when an electron mobile material has been used in the charge-transporting layer, it is particularly effective to make a hole mobile material contained in the charge-generating layer. In the former case, when phthalocyanine and diphenoquinone are added together to the charge-generating layer, a considerable improvement in the electrically charged property and sensitivity and suppressive effect of the residual electric potential can be recognized.

The charge-generating layer or the charge-transporting layer may be formed by immersing a substrate into the liquid coating material for forming the charge-generating layer or into the liquid coating material for forming the charge-transporting layer, respectively, or spraying the liquid coating material to the substrate.

In order to improve the adhesive property or the charge-blocking property, an intermediate layer may be provided between the substrate and the photoconductive layer consisting of a charge-generating layer and a charge-transporting layer. The intermediate layer usually comprises resins as major components. Such resins, however, are desired to be highly durable to usual organic solvents since the resins have to be coated with a photoconductive layer thereon together with a solvent. Such resins include water-soluble resins such as polyvinyl alcohol, casein, sodium polyacrylate, and the like, alcohol-soluble resins such as copolymeric nylon, methoxymethylated nylon, and the like, and hardening type resins forming three-dimensional network structure, such as acrylic resin, polyurethane, melamine resin, phenol resin, epoxy resin, and the like. In order to prevent moire formation and reduce the residual electric potential, a metallic oxide as finely powdered pigment, such as titanium oxide, silica, alumina, zirconium oxide, tin oxide, indium oxide, or the like may be added.

The substrate, on which the photoconductive layer consisting of a charge-generating layer and a charge-transporting layer is formed, includes metallic drums or sheets made of aluminum, brass, stainless steel or nickel, or sheet or cylindric substrates made of plastics or paper such as polyethylene phthalate, polypropylene, nylon or paper on which a metal such as aluminum or nickel has been deposited as vapor or on which a con-ductive material such as titanium oxide, tin oxide, indium oxide or carbon black has been applied together with a proper binder through conductive treatment.

DETAILED DESCRIPTION OF THE PREFERRED EMBODIMENTS

EXAMPLE 1

An aluminum drum, 65mm in diameter and 332mm in length, was prepared. A mixture of 4 parts by weight of alcohol-soluble nylon resin CM8000 (Product of Toray Industries Inc.), 80 parts by weight of methanol and 20 parts by weight of n-butanol was stirred with a stirrer to give a solution as a liquid coating material for forming the underlayer. The drum was immersed in the liquid coating material for forming the underlayer, pulled up, and dried at 120° C. for 120 minutes to form the underlayer of 0.5 μm thickness over the drum.

Subsequently, a mixture of 2 parts by weight of τ-type non-metallophthalocyanine Liophoton TPA-891 (Product of Toyo Ink Mfg. Co., Ltd.), 2 parts by weight of vinyl chloride-vinyl acetate-maleic acid copolymer SOLBIN M (Product of Nisshin Chemical Co. , Ltd.) and 100 parts by weight of MEK (methyl ethyl ketone) was dispersed with a ball mill for 48 hours to give a liquid coating material for forming the charge-generating layer. The drum on which the underlayer had been formed was immersed in the liquid coating material for forming the charge-generating layer, then pulled up, and dried at 120° C. for 10 minutes to form a charge-generating layer of 0.3 μm thickness over the underlayer.

Further, a mixture of 10 parts by weight of a charge-transporting material of the formula:

(21)

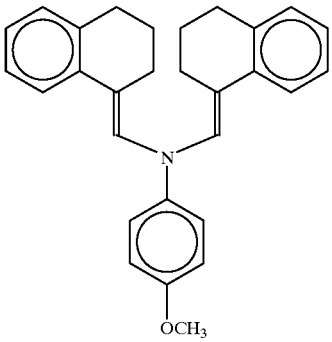

10 parts by weight of polycarbonate resin K1300 (Product of Teijin Chemical Ltd.), 0.002 part by weight of silicon oil KF50 (Product of Shin-Etsu Chemical Co.,Ltd.) and 150 parts by weight of dichloromethane was stirred to give a solution as the liquid coating material for forming the charge-transporting layer. The drum on which the charge-generating layer had been formed was immersed in the liquid coating material for forming the charge-transporting layer, then pulled up, and dried at 120° C. for 20 minutes to form a charge-transporting layer of 25 μm thickness over the charge-generating layer. The electrophotographic photoreceptor was produced in this way.

COMPARATIVE EXAMPLE 1

In place of the vinyl chloride-vinyl acetate-maleic acid copolymer in the coating material for the charge-generating layer in Example 1, 2 parts by weight of butyral resin Essrec BX-1 (Product of Sekisui Chemical Co., Ltd.) was used. The other was made in the same manner as in Example 1 to give a photoreceptor.

COMPARATIVE EXAMPLE 2

In place of the vinyl chloride-vinyl acetate-maleic acid copolymer in the coating material for the charge-generating layer in Example 1, 2 parts by weight of epoxy resin BPO-20E (Product of Riken Chemical Co., Ltd.) was used. The other was made in the same manner as in Example 1 to give a photoreceptor.

COMPARATIVE EXAMPLE 3

In the liquid coating material for forming the charge-generating layer in Example 1, the composition was altered to one comprising 2 parts by weight of the trisazo pigment of the formula:

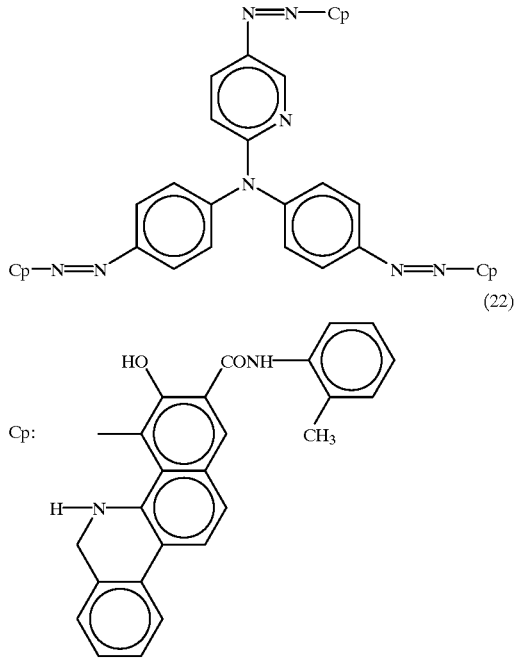

(22)

2 parts by weight of vinyl chloride-vinyl acetate-maleic acid copolymer SOLBIN M (Product of Nisshin Chemical Co., Ltd.) and 100 parts by weight of MEK. The other was made in the same manner as in Example 1 to give a photoreceptor.

COMPARATIVE EXAMPLE 4

In place of the vinyl chloride-vinyl acetate-maleic acid copolymer in the coating material for the charge-generating layer in Comparative Example 3, 2 parts by weight of butyral resin Essrec BX-1 (Product of Sekisui Chemical Co., Ltd.) was used. The other was made in the same manner as in Comparative Example 3 to give a photoreceptor.

The photoreceptors described in Example 1 and Comparative Examples 1 to 4 were installed in a modified version of digital copying machine AR5130 (Product of Sharp Kabushiki Kaisha) and subjected to a copying-durability test. Table 1 shows the results. The copying-durability test was carried out at the initial stage and after making of 30,000 sheets of copying image, respectively, to evaluate the potential VO(−V) at the dark portion and the potential VL(−V) at the light portion. It is favorable as to the sensitivity that the initial potential VL at the light portion is low, and it is also favorable as to the electrostatic stability that the changes of the potential VO at the dark portion and the potential VL at the light portion are small. The photoreceptor of Example 1, that is, the photoreceptor having the charge-generating layer containing the τ-type non-metallic phthalocyanine and the copolymer of vinyl chloride-vinyl acetate type, exhibits higher sensitivity, approximately the same electric potential at the initial stage and after making of 30,000 sheets of copying image, and higher electrostatic stability in repeated use than those of Comparative Examples 1–4.

TABLE 1

| | Charge-generating material | Charge-generating layer Resin | Initial Potential in dark VO(−V) | Initial Potential in light VL(−V) | After 30,000 copy durability Potential in dark VO(−V) | After 30,000 copy durability Potential in light VL(−V) |
|---|---|---|---|---|---|---|
| Ex.1 | τ-type non-metal ph.cyan.* | V.ch. – V.ac. type** | 550 | 120 | 555 | 120 |
| C.Ex.1 | τ-type non-metal ph.cyan.* | Butyral | 545 | 200 | 550 | 200 |
| C.Ex.2 | τ-type non-metal ph.cyan.* | Epoxy | 550 | 150 | 450 | 110 |
| C.Ex.3 | Tris-azo pigment | V.ch. – V.ac. type** | 350 | 100 | 170 | 50 |
| C.Ex.4 | Tris-azo pigment | Butyral | 555 | 260 | 555 | 300 |

*τ-Type non-metallic phthalocyanine
**Vinyl chloride-vinyl acetate type

The photoreceptors of Example 1 and Comparative Examples 1 and 2 were installed in the same copying machine to form the entire white image, that is, white all over the sheet by the inversion development process. Though there was no defect in the images obtained in Example 1 and Comparative Example 1, the image formed in Comparative Example 2 had dark spotted defects. From the above results of evaluation, it was found that the photoreceptor having the charge-generating layer containing the τ-type non-metallic phthalocyanine and the copolymer of vinyl chloride-vinyl acetate type of Example 1 generates an image of lesser defect and exhibits better electrostatic characteristics.

EXAMPLE 2

In the liquid coating material for forming the charge-generating layer of Example 1, the contents of the τ-type non-metallic phthalocyanine and the vinyl chloride-vinyl acetate-maleic acid copolymer were altered to 0.8 part by weight and 3.2 parts by weight, respectively. The other was made in the same manner as in Example 1 to form a photoreceptor.

EXAMPLE 3

In the liquid coating material for forming the charge-generating layer of Example 1, the contents of the τ-type non-metallic phthalocyanine and the vinyl chloride-vinyl acetate-maleic acid copolymer were altered to 1 part by weight and 3 parts by weight, respectively. The other was made in the same manner as in Example 1 to form a photoreceptor.

EXAMPLE 4

In the liquid coating material for forming the charge-generating layer of Example 1, the contents of the τ-type non-metallic phthalocyanine and the vinyl chloride-vinyl acetate-maleic acid copolymer were altered to 3 parts by weight and 1 part by weight, respectively. The other was made in the same manner as in Example 1 to form a photoreceptor.

EXAMPLE 5

In the liquid coating material for forming the charge-generating layer of Example 1, the contents of the τ-type non-metallic phthalocyanine and the vinyl chloride-vinyl acetate-maleic acid copolymer were altered to 3.2 parts by weight and 0.8 part by weight, respectively. The other was made in the same manner as in Example 1 to form a photoreceptor.

The photoreceptors described in Examples 1 to 5 were installed in the same copying machine and subjected to a copying-durability test. Table 2 shows the results. In the photoreceptors of Examples 1, 3 and 4, in which the ratios of the τ-type non-metallic phthalocyanine to the copolymer of vinyl chloride-vinyl acetate type in the charge-generating layer were fixed at 1/3, 1/1 and 3/1 (<-type non-metallic phthalocyanine/copolymer of vinyl chloride-vinyl acetate type), respectively, it was found that the sensitivity was particularly high, the electric potential was approximately the same at the initial stage and after making of 30,000 sheets of copying image, and the electrostatic stability was high in repeated use.

TABLE 2

| | Charge gene.mat./ charge gene. lay.resin* Ratio | Initial Potential in dark VO(-V) | Initial Potential in light VL(-V) | After 30,000 copy durability Potential in dark VO(-V) | After 30,000 copy durability Potential in light VL(-V) |
|---|---|---|---|---|---|
| Ex. 2 | 1/4 | 555 | 170 | 560 | 210 |
| Ex. 3 | 1/3 | 550 | 130 | 550 | 150 |
| Ex. 1 | 1/1 | 550 | 120 | 555 | 120 |
| Ex. 4 | 3/1 | 540 | 120 | 545 | 120 |
| Ex. 5 | 4/1 | 500 | 100 | 490 | 100 |

*Charge-generating material/Charge-generating layer resin

From the above results of evaluation, it was found that the photoreceptors having the charge-generating layer in which the ratio of the τ-type non-metallic phthalocyanine to the copolymer of vinyl chloride-vinyl acetate type is fixed in a range of 1/3 to 3/1 generate a lesser defective image and exhibit high sensitivity and excellent electrostatically stable electrostatic characteristics.

EXAMPLE 6

In the charge-generating layer of Example 1, the film thickness was altered to 0.05 μm. The other was made in the same manner as in Example 1 to form a photoreceptor.

EXAMPLE 7

In the charge-generating layer of Example 1, the film thickness was altered to 0.1 μm. The other was made in the same manner as in Example 1 to form a photoreceptor.

EXAMPLE 8

In the charge-generating layer of Example 1, the film thickness was altered to 0.6 μm. The other was made in the same manner as in Example 1 to form a photoreceptor.

EXAMPLE 9

In the charge-generating layer of Example 1, the film thickness was altered to 0.8 μm. The other was made in the same manner as in Example 1 to form a photoreceptor.

The photoreceptors described in Examples 1 and 6 to 9 were installed in the same copying machine and subjected to a copying-durability test. Table 3 shows the results. It was found that the photoreceptors of Examples 1, 7 and 8, in which the thickness of the charge-generating layer was 0.1, 0.3 and 0.6 μm, respectively, have particularly high sensitivity and approximately the same electric potential at the initial stage and after making of 30,000 sheets of copying image, and are excellent in electrostatic stability in repeated use.

TABLE 3

| | Charge-generating layer thickness (μm) | Initial Potential in dark VO(-V) | Initial Potential in light VL(-V) | After 30,000 copy durability Potential in dark VO(-V) | After 30,000 copy durability Potential in light VL(-V) |
|---|---|---|---|---|---|
| Ex. 6 | 0.05 | 560 | 200 | 565 | 210 |
| Ex. 7 | 0.1 | 550 | 135 | 555 | 140 |
| Ex. 1 | 0.3 | 550 | 120 | 555 | 120 |

TABLE 3-continued

| | Charge-generating layer thickness (μm) | Initial Potential in dark VO(-V) | Initial Potential in light VL(-V) | After 30,000 copy durability Potential in dark VO(-V) | After 30,000 copy durability Potential in light VL(-V) |
|---|---|---|---|---|---|
| Ex. 8 | 0.6 | 545 | 105 | 540 | 110 |
| Ex. 9 | 0.8 | 510 | 80 | 470 | 70 |

From the above results of evaluation, it was found that the photoreceptors having the charge-generating layer which has 0.1–0.6 μm in thickness generate a lesser defective image and exhibit a high sensitivity and excellent electrostatically stable electrostatic characteristics.

EXAMPLE 10

An aluminum drum, 65 mm in diameter and 350 mm in length, was prepared. A mixture of 4 parts by weight of water-soluble polyvinyl acetal resin KW-1 (Product of Sekisui Chemical Co., Ltd.), 80 parts by weight of methanol and 20 parts by weight of water was stirred with a stirrer to give a solution as a liquid coating material for forming the underlayer. The drum was immersed in the liquid coating material for forming the underlayer, then pulled up, and dried at 120° C. for 120 minutes to form the underlayer of 1 μm thickness on the drum.

Subsequently, a mixture of 2 parts by weight of τ-type non-metallophthalocyanine Liophoton TPA-891 (Product of Toyo Ink Mfg. Co., Ltd.), 2 parts by weight of vinyl chloride-vinyl acetate-maleic acid copolymer SOLBIN MF (Product of Nisshin Chemical Co., Ltd.) and 100 parts by weight of MEK was dispersed with a ball mill for 48 hours to give a liquid coating material for forming the charge-generating layer. The drum on which the underlayer had been formed was immersed in the liquid coating material for forming the charge-generating layer, then pulled up, and dried at 120° C. for 10 minutes to form a charge-generating layer of 0.3 μm thickness over the underlayer.

Further, a mixture of 8 parts by weight of a charge-transporting material of the formula:

(23)

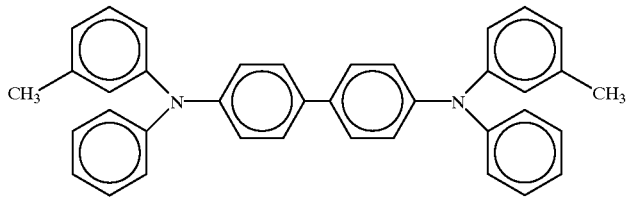

10 parts by weight of polycarbonate resin Z200 (Product of Mitsubishi Gas Chemical Co., Ltd.), 0.002 part by weight of silicon oil KF50 (Product of Shin-Etsu Chemical Co., Ltd.) and 120 parts by weight of dichloromethane was stirred to give a solution as the liquid coating material for forming the charge-transporting layer. The drum on which the charge-generating layer had been formed was immersed in the liquid coating material for forming the charge-transporting layer, then pulled up, and dried at 120° C. for 20 minutes to form a charge-transporting layer of 35 μm thickness over the charge-generating layer. The electrophotographic photoreceptor was produced in this way.

EXAMPLE 11

In place of the liquid coating material for forming the charge-generating layer of Example 10, the liquid coating material for forming the charge-generating layer of Example 1 was used. The other was made in the same manner as in Example 10 to give a photoreceptor.

EXAMPLE 12

In place of the vinyl chloride-vinyl acetate-acrylic acid copolymer in the liquid coating material for forming the charge-generating layer of Example 10, 2 parts by weight of vinyl chloride-vinyl acetate copolymer SOLBIN C (Nisshin Chemical Co., Ltd.) was used. The other was made in the same manner as in Example 10 to give a photoreceptor.

EXAMPLE 13

In place of the vinyl chloride-vinyl acetate-acrylic acid copolymer in the liquid coating material for forming the charge-generating layer of Example 10, 2 parts by weight of vinyl chloride-vinyl acetate-vinyl alcohol copolymer SOLBIN A (Nisshin Chemical Co., Ltd.) was used. The other was made in the same manner as in Example 10 to give a photoreceptor. The content of the vinyl alcohol component in the copolymer was 5% by weight calculated from the monomer.

EXAMPLE 14

In place of the vinyl chloride-vinyl acetate-acrylic acid copolymer in the liquid coating material for forming the charge-generating layer of Example 10, 2 parts by weight of vinyl chloride-vinyl acetate-vinyl alcohol copolymer SOLBIN A5 (Nisshin Chemical Co., Ltd.) was used. The other was made in the same manner as in Example 10 to give a photoreceptor. The content of the vinyl alcohol component in the copolymer was 12% by weight calculated from the monomer.

The photoreceptors described in Examples 10 to 14 were installed in the same copying machine and subjected to a copying-durability test. Table 4 shows the results. It was found that the photoreceptors of Examples 11–14, in which the charge-generating layer respectively contained vinyl chloride-vinyl acetate-maleic acid copolymer, vinyl chloride-vinyl acetate copolymer and vinyl chloride-vinyl acetate-vinyl alcohol copolymer as the copolymer of vinyl chloride-vinyl acetate type, have high sensitivity and approximately the same electric potential at the initial stage and after making of 30,000 sheets of copying image and are excellent in electrostatic stability in repeated use. It was also found that the photo-receptor having the charge-generating layer containing vinyl chloride-vinyl acetate-vinyl alcohol copolymer, particularly when the content of the vinyl alcohol component was 10% by weight or more calculated from the monomer, exhibited excellent sensitivity.

TABLE 4

| | Charge-generating layer resin* | Initial | | After 30,000 copy durability | |
|---|---|---|---|---|---|
| | | Potential in dark VO(-V) | Potential in light VL(-V) | Potential in dark VO(-V) | Potential in light VL(-V) |
| Ex. 10 | VC-VA-AA | 660 | 160 | 660 | 155 |
| Ex. 11 | VC-VA-MA | 650 | 130 | 650 | 135 |
| Ex. 12 | VC-VA | 640 | 130 | 645 | 130 |
| Ex. 13 | VC-VA-Va (5%) | 665 | 150 | 660 | 145 |
| Ex. 14 | VC-VA-Va (12%) | 660 | 135 | 660 | 125 |

COMPARATIVE EXAMPLE 5

The composition of the liquid coating material for forming the charge-generating layer in Example 1 was altered to one comprising 2 parts by weight of τ-type non-metallic ophthalocyanine Liophoton TPA-891 (Product of Toyo Ink Mfg. Co., Ltd.), 2 parts by weight of vinyl chloride-vinyl acetate-maleic acid copolymer SOLBIN M (Product of Nisshin Chemical Co., Ltd.) and 100 parts by weight of tetrahydrofuran (THF). The other was made in the same manner as in Example 1 to give a photoreceptor.

The photoreceptors described in Examples 1 and Comparative Example 5 were installed in the same copying machine to determine the initial electric potential. Table 5 shows the results. It was found that the photoreceptor of Example 1 in which the charge-generating layer contained MEK exhibited high sensitivity. From the above result, ketone type solvents such as MEK was found favorable as dispersing media.

TABLE 5

| | Dispersing medium in the charge-generatg. layer | Initial Potential in dark VO(-V) | Initial Potential in light VL(-V) |
|---|---|---|---|
| Example 1 | MEK | 550 | 120 |
| Com. Ex. 5 | THF | 560 | 200 |

Moreover, the liquid coating media for forming the charge-generating layer of Examples 11–13 and Comparative Example 2 were placed in a tightly closed vessel and allowed to stand at ordinary temperature to observe the state of the media. Table 6 shows the results. It was found that the liquid coating media for forming the charge-generating layer of Examples 11–13, which respectively contained vinyl chloride-vinyl acetate-maleic acid copolymer, vinyl chloride-vinyl acetate copolymer and vinyl chloride-vinyl acetate-vinyl alcohol copolymer as the copolymer of vinyl chloride-vinyl acetate type, particularly the media containg vinyl chloride-vinyl acetate-maleic acid copolymer and vinyl chloride-vinyl acetate-vinyl alcohol copolymer exhibited high stability in storage.

TABLE 6

| | Charge-generating layer resin | State of Coating Media After 7 days standing | After 30 days standing |
|---|---|---|---|
| Comp. Ex. 5 | Epoxy resin | Pptn. of pigment at the bottom | Pptn. of pigment at the bottom |
| Ex. 11 | VC-VA-MA* | No change | No change |
| Ex. 12 | VC-VA* | No change | Pptn. of pigment at the bottom |
| Ex. 13 | VC-VA-Va* (5%) | No change | No change |

*VC—VA—MA: vinyl chloride-vinyl acrylic acid copolymer;
*VC—VA: vinyl chloride-vinyl acetate copolymer;
*VC—VA—Va: vinyl chloride-vinyl acetate-vinyl alcohol copolymer The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. An electrophotographic photoreceptor comprising:

a conductive support;

a charge-generating layer; and a charge-transporting layer, wherein the charge-generating layer and charge-transporting layer are provided on the conductive support, and wherein the charge-generating layer comprises a τ-type non-metallic phthalocyanine having one or more peaks at Bragg's angle (20±0.2°) of at most 21.7° and a copolymer of vinyl chloride-vinyl acetate.

2. The electrophotographic photoreceptor of claim 1, wherein a ratio of the τ-type non-metallic phthalocyanine to the copolymer of vinyl chloride-vinyl acetate type is in a range of 1/3–3/1 by weight (τ-type non-metallic phthalocyanine/copolymer of vinyl chloride-vinyl acetate type).

3. The electrophotographic photoreceptor of claim 1, wherein a thickness of the charge-generating layer is fixed in a range of 0.1 μm–0.6 μm.

4. The electrophotographic photoreceptor of claim 1, wherein a vinyl chloride-vinyl acetate copolymer is selected as the copolymer of vinyl chloride-vinyl acetate type.

5. The electrophotographic photoreceptor of claim 1, wherein a vinyl chloride-vinyl acetate-maleic acid copolymer is selected as the copolymer of vinyl chloride-vinyl acetate type.

6. The electrophotographic photoreceptor of claim 1, wherein a vinyl chloride-vinyl acetate-vinyl alcohol copolymer is selected as the copolymer of vinyl chloride-vinyl acetate type.

7. The electrophotographic photoreceptor of claim 6, wherein a content of the vinyl alcohol component is at least 10% by weight calculated as a monomer in the vinyl chloride-vinyl acetate-vinyl alcohol copolymer.

8. A process for producing an electrophotographic photoreceptor comprising a conductive support, and charge-generating and charge-transporting layers which are provided on the conductive support, the process comprising the step of:

applying a liquid coating material for forming the charge-generating layer to the conductive support to form the charge-generating layer, wherein the liquid coating material for forming the charge-generating layer is prepared by dispersing in a ketone solvent a τ-type non-metallic phthalocyanine having one or more peals at Bragg's angle (20±0.20°) of at most 21.7°.

9. The process for producing an electrophotographic photoreceptor of claim 8, wherein the liquid coating material for forming the charge-generating layer contains a copolymer of vinyl chloride-vinyl acetate type as a binder resin.

10. The process for producing an electrophotographic photoreceptor of claim 9, wherein the liquid coating material contains a vinyl chloride-vinyl acetate-maleic acid copolymer as the copolymer of vinyl chloride-vinyl acetate type.

11. The process for producing an electrophotgraphic photoreceptor of claim 9, wherein the liquid coating material contains a vinyl chloride-vinyl acetate-vinyl alcohol copolymer as the copolymer of vinyl chloride-vinyl acetate type.

12. An image-forming apparatus in which an electrophotographic photoreceptor is used to form an image by an inversion development process, wherein the electrophotographic photoreceptor is a electrophotographic photoreceptor of any one of claims 1 to 7.

* * * * *